US006094002A

United States Patent [19]

Bae et al.

[11] Patent Number: 6,094,002

[45] Date of Patent: Jul. 25, 2000

[54] CRT SOCKET AND CRT ASSEMBLY EMPLOYING THE SAME

[75] Inventors: Min-cheol Bae; Yong-geol Kwon; Deog-ho Kim; Kue-hong Lee; Jae-young Ha, all of Suwon; Dong-won Lim, Uiwang, all of Rep. of Korea

[73] Assignee: Samsung Display Devices Co., Ltd., Kyungki-Do, Rep. of Korea

[21] Appl. No.: 09/131,408

[22] Filed: Aug. 10, 1998

[30] Foreign Application Priority Data

Aug. 11, 1997 [KR] Rep. of Korea ..... 97-21852
Aug. 3, 1998 [KR] Rep. of Korea ..... 97-31494

[51] Int. Cl.[7] ..... H01J 5/48

[52] U.S. Cl. ..... 313/318.01; 313/318.12

[58] Field of Search ..... 313/318.01, 318.05, 313/318.06, 318.12

*Primary Examiner*—Vip Patel
*Attorney, Agent, or Firm*—Leydig, Voit & Mayer

[57] ABSTRACT

A socket for interconnecting first and second lead pins fixed to a neck portion of a CRT at an array angle and to which a high voltage and a low voltage are applied, respectively, and a socket board including signal lines having an array angle different from that of the second lead pins, the socket including connector pins each having a pin holder portion connected to the second lead pin, an outer pin portion connected to the signal line, and an extension portion connecting the pin holder portion to the outer pin portion, and a socket main body to which the connector pins are fixed, wherein the array angle between the outer pin portions is the same as that between the signal lines.

8 Claims, 5 Drawing Sheets

CRT SOCKET AND CRT ASSEMBLY EMPLOYING THE SAME

BACKGROUND OF THE INVENTION

1. Field of the Invention

The present invention related to a CRT assembly, and more particularly, to a socket connected to lead pins mounted on a neck portion of the CRT and a socket board, for applying a voltages to the respective lead pins, and a CRT assembly employing the socket.

2. Description of the Related Art

A conventional CRT assembly, as shown in FIGS. 1 and 2, includes a CRT 10, a socket 20 having a plurality of connector pins 22 connected to lead pins 12 on a neck portion 11 of the CRT 10, for applying a voltages to the lead pins 12, and a socket board 30 on which signal lines 31 for applying a voltages to the connector pins 22 are formed in a pattern.

The CRT 10 includes a panel 112 having a fluorescent layer 111, and a funnel 113 sealed to the panel 112. An electron gun 13 is installed in a neck portion 11 of the funnel 113. The electron gun 13 includes a multitude of electrodes 13*a* fixed to a bead glass 13*b* at intervals. The respective electrodes 13*a* of the electron gun 13 are electrically connected to the lead pins 12 by connectors 13*c*. A plurality of holes 21*a* in a main body 21 of the socket 20 have the same array pattern as the lead pins 12, and a fixation portion 21*b* for fixing the connector pins 22 is located at the outer peripheral surface of the main body 21.

A connector pin 22 includes a lead pin holder portion 22*a* and is inserted into a hold 21*a* of the main body 21 for to the lead pin 12, and an outer pin portion 22*b* extending from the lead pin holder portion 22*a* and fixed to the fixation portion 21*b*. Here the array center of the lead pin holder portion 22*a* coincides with that of the outer pin portion 22*b*. Also, the array angle A between the holes 21*a* with respect to the array center, that is, the array angle of the lead pin holder portion 22*a* is the same as the array angle B between the signal lines 31, that is, the array angle of the outer portion 22*b*.

The signal lines 31 on the socket board 30 correspond to the array pattern of the outer pin portion 22*b*. A connection hole 31*a* into which the output pin portion 22*b* is inserted and soldered is formed in the signal line 31.

Also, the lead pin 12 includes a high-voltage lead pin 12*a* to which a high voltages are applied and low-voltage lead pins 12*b* to which low voltage is applied.

In the CRT assembly constructed as above, if the number of the high-voltage lead pins 12*a* for applying a voltage to focusing electrodes of a main lens of an electron gun, increases due to an increase in the number of the focusing electrodes, the number of the holes 21*a* of the socket 20 connected thereto must increase as well. Thus, since the array angle A between the holes 21*a* to which the low-voltage lead pins 12*b* are connected is reduced a rearrangement is required such that the array angle A between the low-voltage lead pins 12*b* and the array angle B between the signal lines 31 of the socket board 30 are reduced. Thus, if the number of lead pins changes, even though circuit characteristics for applying a voltage to the electron gun are retained without change, the signal lines 31 of the socket board 30 must be rearranged to satisfy the reduced array angle requirements.

To overcome this problem, as shown in FIG. 2, while the number of lead pins 12 is kept constant, a resistor 14 is installed between an electrode connected to the lead pin 12 and an additionally installed electrode to apply a reduced voltage to the additionally installed electrode.

Since the voltage-reducing resistor 14 is installed within the CRT, it is difficult to install during assembly of the CRT. Also, it is not easy to attain reliability in the course of manufacturing the CRT in which a high-temperature and high-voltage splash process must be carried out. Particularly, when the resistance level is changed due to deteriorated resistance during the manufacturing process, focusing characteristics may be degraded.

SUMMARY OF THE INVENTION

To solve the above problems, it is an objective of the present invention to provide a CRT socket which allows a conventional socket board to be used as it is even if the number of lead pins changes, and a CRT assembly having the socket.

It is another objective of the present invention to provide a socket having a resistor installed at an exterior side of a CRT for reducing the voltage and applying the reduced voltage to electrodes constituting an electron gun; and a CRT assembly having the socket.

Accordingly, to achieve the above objective, there is provided a socket for interconnecting first and second lead pins fixed to a neck portion of a CRT at a predetermined array angle and to which a high voltage and a low voltage are applied, respectively, and a socket board on which signal lines are formed at an array angle different from that of the second lead pins, the socket including a plurality of connector pins each having a pin holder portion connected to the second lead pin, an outer pin portion connected to the signal line, and an extension portion connected the pin holder portion and the outer pin portion, and a socket main body to which the connector pins are fixed, wherein the array angle between the outer pin portions is the same as that between the signal lines.

There are at least two first lead pins, and the socket includes at least two connector portions to which the first lead pins are connected, and a resistor for interconnecting the connector portions.

Also, at least one of the extension portions of the connector pins connects the pin holder and the outer pin portions obliquely.

According to another aspect of the present invention, there is provided a CRT assembly including a CRT including a funnel sealed to a panel and having a neck portion, an electron gun mounted in the neck portion and having a plurality of electrodes, and first and second lead pins fixed to the neck portion at a predetermined array angle and to which a high voltage and a low voltage are applied, respectively, a socket board on which signal lines are formed at an array angle different from that of the second lead pins to apply a voltage, and a socket including a socket main body having holes formed at the same array angle as that of the second lead pins, and a plurality of connector pins having pin holder portions installed in the holes and connected to the second lead pins having pin holder portions connected to the signal lines and extension portions connected to the pin holder portions and the outer pin portions, the array angle of the outer pin portions being the same as that of the signal lines.

BRIEF DESCRIPTION OF THE DRAWINGS

The above objectives and advantages of the present invention will become more apparent by describing in detail a preferred embodiment thereof with reference to the attached drawings in which.

DESCRIPTION OF THE PREFERRED EMBODIMENTS

Figure 3:
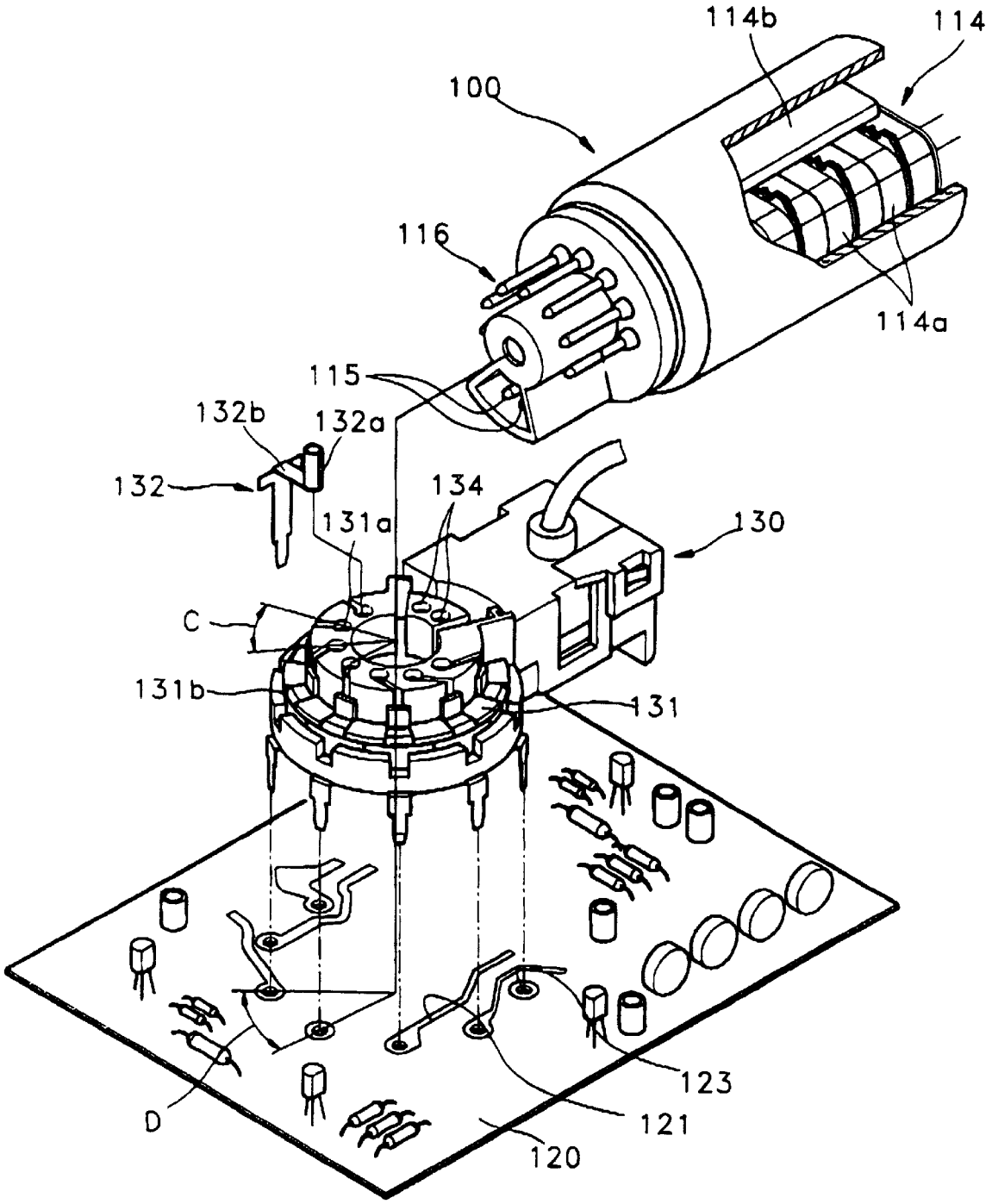
FIG. 3 is a partially cut-away perspective view illustrating a socket according to the present invention and a CRT assembly employing the socket.

FIG. 3 shows a part of a CRT assembly employing a socket according to a preferred embodiment of the present invention.

Figure 1:
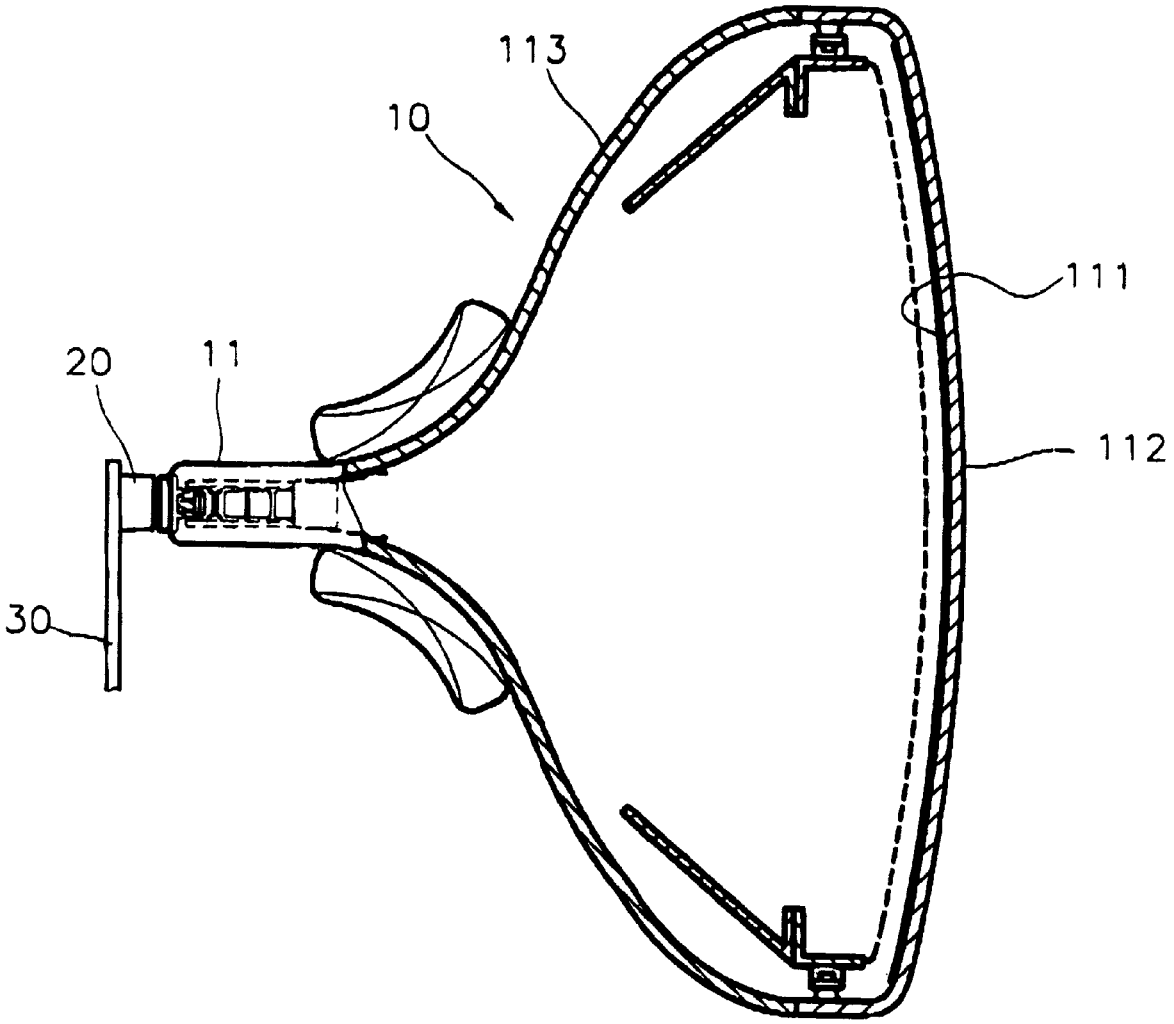
FIG.1 (PRIOR ART)
FIG. 1 is a cross-sectional view illustrating a conventional CRT assembly.

As shown in FIG. 3, an electron gun 114 is mounted in a neck portion 100 of a CRT (10 of FIG. 1). The electron gun 114 comprises a plurality of electrodes 114*a* fixed on a bead glass 114*b* at intervals. The respective electrodes 114*a* are connected to first lead pins 115 and second lead pins, fused to the neck portion 100, by conductive wires.

The first and second lead pins 115 and 116 are arranged in a circular shape. The first lead pins 115 apply a relatively high voltage to electrodes constituting a main lens of the electron gun 114. Also, there are 7–9 second lead pins 116, and the second lead pins 116 apply lower voltages to electrodes constituting an auxiliary lens of the electron gun 114 and a cathode assembly than the voltage applied to electrodes constituting the main lens.

The space between the first lead pin 115 and the second lead pin 116 adjacent thereto is wider than that between the second lead pins 116.

The first and second lead pins 115 and 116 are connected to a socket 130 which is connected to a socket board 120.

Figure 4:
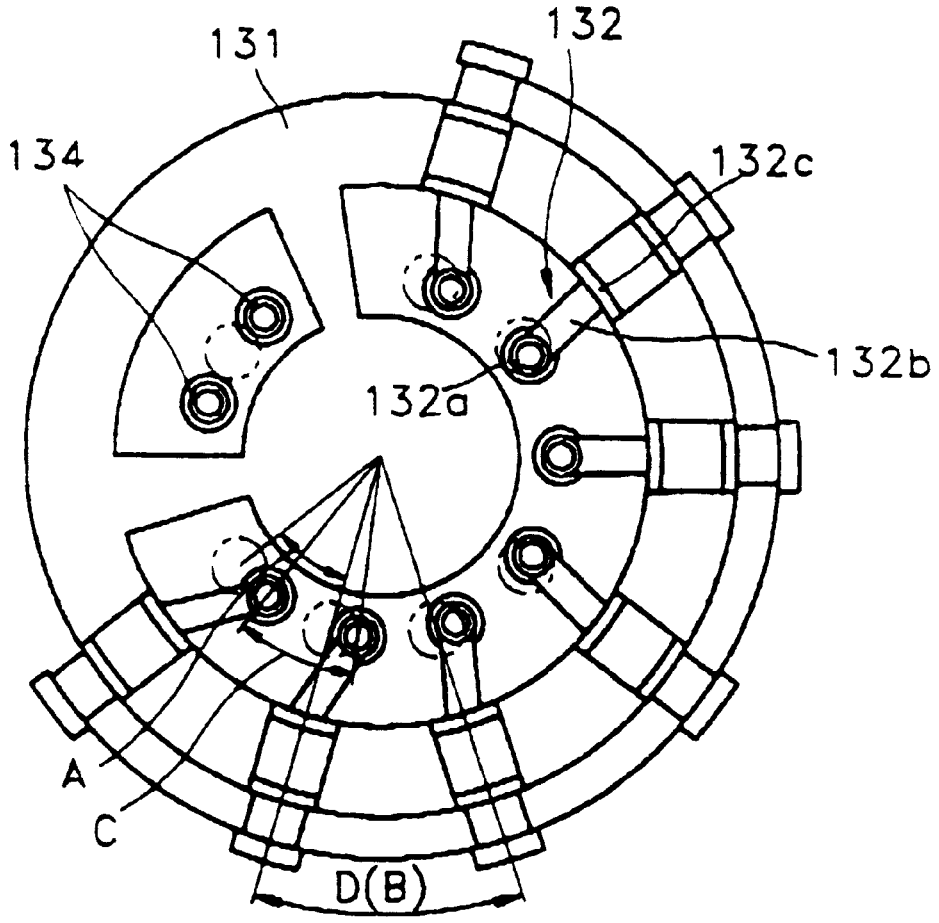
FIG. 4 is a plan view illustrating the socket shown in FIG. 3.

The socket 130, as shown in FIGS. 3 and 4, includes a socket main body 131, a plurality of connector pins 132 installed in a fixation portion 131*b* of the socket main body 131 and connected to the second lead pins 116, and a connector portion 134 connected to the first lead pins 115.

A plurality of holes 131*a* in the socket 130 are in the same array pattern as that of the second lead pins 116. The connector pin 132 includes a pin holder portion 132*a* inserted into the hole 131*a* to be connected to the second lead pin 116, an extension portion 132*b* extending from the pin holder portion 132*a,* and an outer pin portion 132*c* extending from the extension portion 132*b* to the lower portion of the main body 131 to be soldered to the connection hole 123 of the signal line 121 of the socket board 120.

Figure 2:
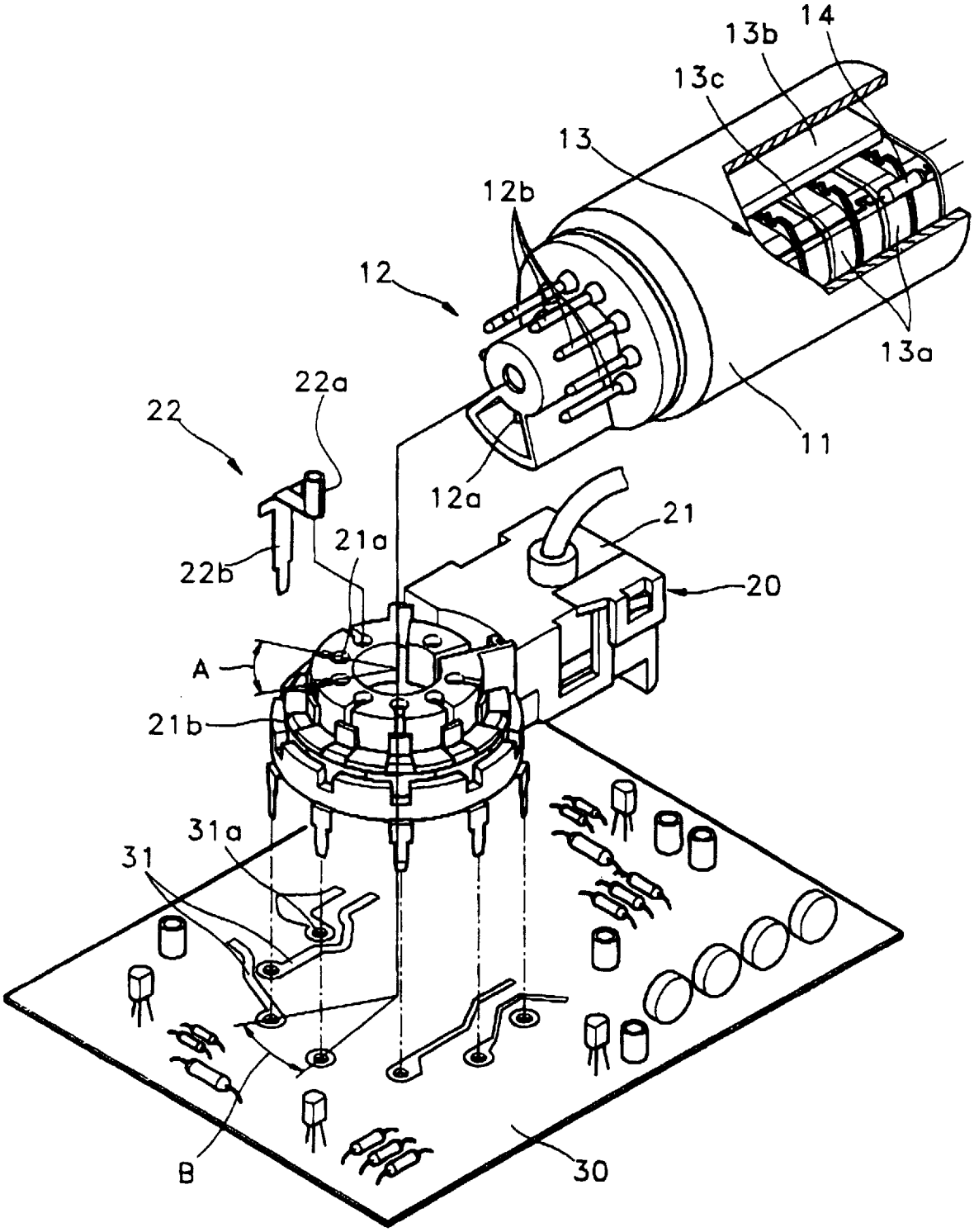
FIG.2 (PRIOR ART)
FIG. 2 is a partially cut-away perspective view illustrating a CRT assembly employing a conventional socket.

According to this embodiment, the number of first lead pins 115 is increased to two, compared to that of the high-voltage lead pin 12*a,* i.e., one on FIG. 2. Also, the array angle C between the holes 131*a,* that is, the array angle in the pin holder portion 132*a* inserted into the hole 131*a,* is less than the array angle A between the holes 21*a* shown in FIG. 2 (indicated by dotted lines in FIG. 4). However, the array angle D between the signal lines 121 of the socket board 120 connected to the outer pin portion 132*c,* that is, the array angle in the outer pin portion 132*c,* is the same as the array angle B between the signal lines 31 of the conventional socket board (30 of FIG. 2). Thus, the array angle at the pin holder portion 132*a* is different from that at the outer pin holder 132*c*.

Since the array angle at the pin holder portion 132*a* is different from that of the outer pin portion 132*c,* the extending portion 132*b* cannot connect the pin holder portion 132*a* and the outer pin portion 132*c* linearly, but them obliquely, according to their locations, as shown in FIG. 4. Therefore, even if the interval between the holes 132*a* connected to the second lead pins 116 and the pin holder portion 132*a* is changed due to an increase in the number of first lead pins 115, the conventional socket board (30 of FIG. 2) can be used.

Figure 5:
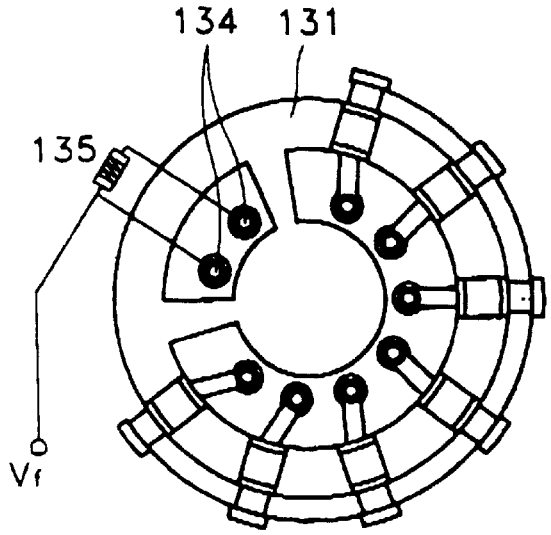
FIGS. 5 and 6 are plan views illustrating a resistor installed at a connector portion of the socket according to the present invention.

The connector portion 134 to which the first lead pins 115 are connected is not fixed to the socket board 120 but is connected to a high-voltage terminal (not shown) connected to a main board of the CRT to thus apply a high voltage to the first lead pins 115. At this time, in the case of two or more second lead pins 115, as shown in FIG. 5, a reduced voltage is applied to a neighboring connector portion through a resistor 135 installed between the connector portions 134. Thus, the scheme for supplying a high voltage to the first lead pins 115 is simplified.

Figure 6:
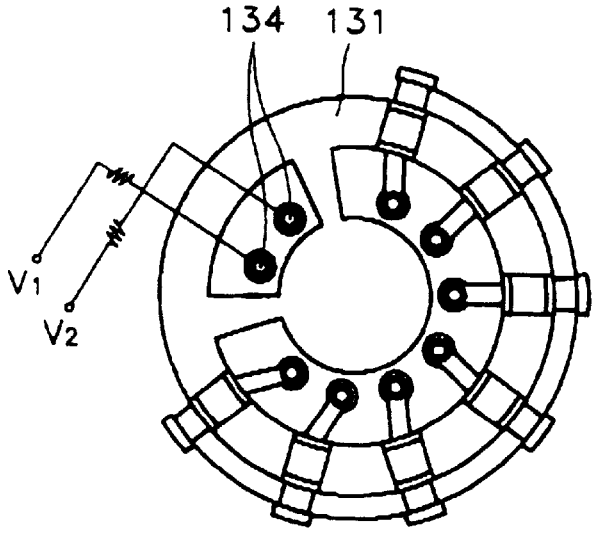

Alternatively, as shown in FIG. 6, a reduced voltage can be directly applied to the respective connector portions 134 through a resistor installed in the main body.

As described above, according to the present invention, even if the array internal between holes to which lead pins are connected and the array interval in a pin holder portion of a connector pin are changed, the conventional socket board can be used. Thus, compatibility of socket boards for CRTs having different circuit characteristics can be attained. Also, fabrication of a CRT is simplified by installing a resistor in a main body between connector portions for applying a high voltage to first lead pins, in contract with the conventional case.

The present invention has been described with reference to embodiments shown in the drawings, by way of illustration only. It is understood that various changes and equivalents may be made by those skilled in the art without departing from the spirit and scope of the appended claims. Thus, the actual scope of the invention is intended to be defined in the appended claims.

What is claimed is:

1. A socket for interconnecting first and second lead pins fixed to a neck portion of a CRT at an array angle and to which high voltages and low voltages are applied, respectively, and a socket board including signal lines at an array angle different from that of the second lead pins, the socket comprising:

a plurality of connector pins, each connector pin having a pin holder portion connectable to the second lead pin, an outer pin portion connectable to a signal line, and an extension portion connecting the pin holder portion to the outer pin portion wherein the second lead pins have a different array angle than the signal lines; and a socket main body to which the connector pins are fixed, wherein the array angle between adjacent outer pin portions is the same as the array angle between the signal lines.

2. The socket according to claim 1, further comprising:

at least one connector portion connectable to the first lead pins; and a resistor in the socket main body, for reducing a voltage applied to at least one of the connector portions.

3. The socket according to claim 1, including at least two first lead pins, and wherein the socket includes at least two connector portions to which the first lead pins are connectable, and a resistor interconnecting connector portions.

4. The socket according to claim 1, wherein at least one of the extension portions of the connector pins connects the pin holder portions and the outer pin portions obliquely relative to a central axis of the socket.

5. A CRT assembly comprising:

a CRT including a funnel sealed to a panel and having a neck portion, an electron gun mounted in the neck portion and having a plurality of electrodes, first and second lead pins fixed to the neck portion at an array angle and to which high voltages and low voltages are applied, respectively;

a socket board including signal lines at an array angle different from that of the second lead pins; and a socket including a socket main body having holes at the same array angle as the second lead pins, and a plurality of connector pins having pin holder portions located in the holes and connected to the second lead pins, outer pin portions connected to the signal lines, and extension portions connecting the pin holder portions to the outer pin portions, the array angle of the outer pin portions being the same as the array angle of the signal lines.

6. The CRT assembly according to claim 5, further comprising:

at least one connector connected portion to the first lead pins; and a resistor in the socket main body, for reducing a voltage applied to at least one of the connector portions.

7. The CRT assembly according to claim 5, including at least two first lead pins, and wherein the socket includes at least two connector portions to which the first lead pins are connected, and a resistor interconnecting connector portions.

8. The CRT assembly according to claim 5, wherein at least one of the extension portions of the connector pins connect the pin holder portions and the outer pin portions obliquely relative to a central axis of the socket.

* * * * *